US005244268A

United States Patent [19]

Derrickson

[11] Patent Number: 5,244,268

[45] Date of Patent: Sep. 14, 1993

[54] CARRYING CASE FOR FOOD ITEMS

[76] Inventor: Elizabeth J. Derrickson, 85 Vernon Rd., Waldorf, Md. 20601

[21] Appl. No.: 913,062

[22] Filed: Jul. 14, 1992

[51] Int. Cl.[5] ..... A47B 95/02

[52] U.S. Cl. ..... 312/244; 206/545; 206/549; 220/404; 220/412; 312/293.2

[58] Field of Search ..... 312/117, 407, 404, 244, 312/322, 293.2, 234.1, 234.3, 234.4, 209; 206/545, 546, 549, 541; 220/404, 410, 412, 528; 24/587

[56] References Cited

U.S. PATENT DOCUMENTS

| | | | |
|---|---|---|---|
| 1,590,586 | 6/1926 | McDonald . | |
| 1,994,857 | 3/1935 | Krause . | |
| 2,604,373 | 7/1952 | Beriou et al. . | |
| 2,919,169 | 12/1959 | Jackson | 312/244 |
| 2,947,462 | 8/1960 | Bostock | 220/410 |
| 3,516,596 | 6/1970 | Madden et al. | 220/410 |
| 3,608,712 | 9/1971 | Savoic | 220/404 |
| 4,065,021 | 12/1977 | Kedzierski | 312/209 |
| 4,332,344 | 6/1992 | Strodthoff | 24/587 |
| 4,437,714 | 3/1984 | Struck . | |
| 5,067,208 | 11/1991 | Herrington, Jr. et al. | 24/587 |
| 5,096,056 | 3/1992 | Garcia | 220/528 |
| 5,105,969 | 4/1992 | Lamas | 220/404 |
| 5,119,958 | 6/1992 | Gabert et al. | 220/404 |
| 5,140,727 | 8/1992 | Dais et al. | 24/587 |

*Primary Examiner*—Kenneth J. Dorner
*Assistant Examiner*—Janet M. Long
*Attorney, Agent, or Firm*—Richard C. Litman

[57] ABSTRACT

A case for carrying condiments, spices and other food items in an airtight and moistureproof environment. The case has slotted compartments in which resealable pouches are provided. The pouches are detachably fastened to the sides of these compartments. Various condiments, spices or other food items can be easily transported in the case for later use.

17 Claims, 3 Drawing Sheets

CARRYING CASE FOR FOOD ITEMS

BACKGROUND OF THE INVENTION

1. Field of the Invention

The present invention relates to a carrying case for food items. More specifically, the invention is a uniquely constructed case for condiments, spices and other food items, for the user to store such food items in a manner whereby they can be carried and used as desired at a later time.

2. Description of the Prior Art

There have been various attempts at making various amounts of condiments, spices and other food items portable for use in places other than a conventional kitchen.

U.S. Pat. No. 4,437,714, issued Mar. 20, 1984 to Gordon K. Struck, discloses a portable bar/cabinet for holding condiments, spices and other food items in metal containers placed in holes in the top of the cabinet. The holes are each of such a size and shape as to accommodate the metal containers without the metal containers falling to the bottom of the cabinet.

U.S. Pat. No. 2,604,373, issued Jul. 22, 1952 William P. Beriou et al., discloses a convertible table and bar for holding items used in making mixed alcoholic beverages, such as glasses, bottles and fruit wedges.

U. S. Pat. No. 1,994,857, issued Mar. 19, 1935 to Ernest Krause, discloses a portable bar for holding glasses, bottles and a radio.

U.S. Pat. No. 1,590,586, issued Jun. 29, 1926 to Edward J. McDonald, discloses a camp kit for holding various items; however, it has no handle and opens in the front. It also has the compartments accessible from the front instead of the top.

None of the patents or other inventions known to applicant, taken either singly or in combination, discloses the unique construction of the present invention whereby food items such as spices and condiments are maintained in a waterproof and airtight condition while being carried in a convenient case for later use.

SUMMARY OF THE INVENTION

This invention provides a carrying case for condiments, spices and other food items, the case having removable interior dividers defining an adjustably configured of compartments. These compartments may be used directly for supporting food items, or may provide support to receptacles placed therewithin. Preferably, the compartments support resealable pouches which can keep food items in a water- and air-tight condition. Provision is made for labels identifying the food items.

It is an object, advantage and feature of the invention to provide a carrying case for condiments, spices or other food items.

It is another object, advantage and feature of the invention to provide for the storage of condiment packages, or other receptacles holding small amounts of condiments, spices or other food items.

Still a further object, advantage and feature of the invention is to provide a pouch within a carrying case to maintain food items in an airtight conditions to retain freshness.

Yet another object, advantage and feature of the invention is to provide a pouch within a carrying case to maintain food items in a moistureproof condition to prevent leakage of the food items.

A further object, advantage and feature of the invention is to provide a construction for each pouch within the carrying case which is expandable to hold food items of various sizes and amounts.

Another object, advantage and feature of the invention is to provide a uniquely constructed carrying case having a plurality of resealable pouches therein which can be used on vacations or trips to maintain a variety of food items such as condiments, spices, snacks or other foods in a moistureproof and airtight condition.

These and other objects of the invention will become apparent from the description, drawings and claims herein.

BRIEF DESCRIPTION OF THE DRAWINGS

Like reference characters identify like components throughout the drawings and description herein.

DETAILED DESCRIPTION OF THE PREFERRED EMBODIMENT

Figure 1:
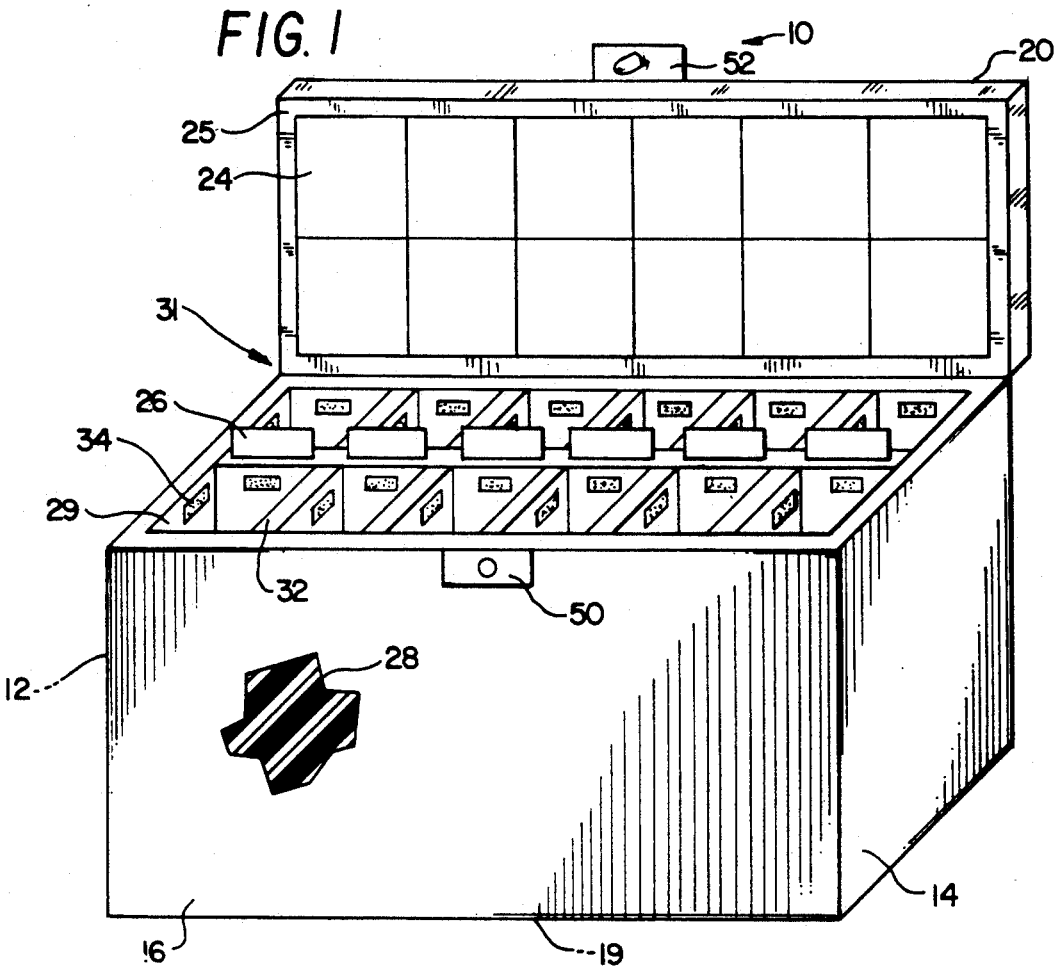
FIG. 1 is a perspective view of the carrying case with its closure open.

Referring now to the drawings, FIG. 1 shows carrying case 10 having a left side 12, a right side 14, a front side 16, a back side 18 and a bottom 19. Each of the respective sides attaches to the bottom 19, forming the lower portion 11 of carrying case 10. Top 20 is secured to lower portion 11 by hinges 22 or similar fasteners which allow for top 20 to be easily openable. Top 20 has identification markers 24 located on an inside surface. These identifications markers 24, or, alternatively, identification markers 26, discussed herein, can be used to identify the location of various condiments, spices or other food items within case 10. The lower portion 11 has a latch 50 which interlocks with top latch member 52 on the top 20 to retain the case 10 in a closed position. Sides 12, 14, 16 and 18, as well as bottom 19 and top 20, can be constructed of variety of materials, either being a single layer of material layers or multiple layers of various materials. Where multiple layers are employed, one layer of material 28 is preferably of low thermal conductivity to assist in the prevention of spoilage of items within case 10. The insulation layer 28 is shown on the interior surface 29 of case 10.

Figure 2:
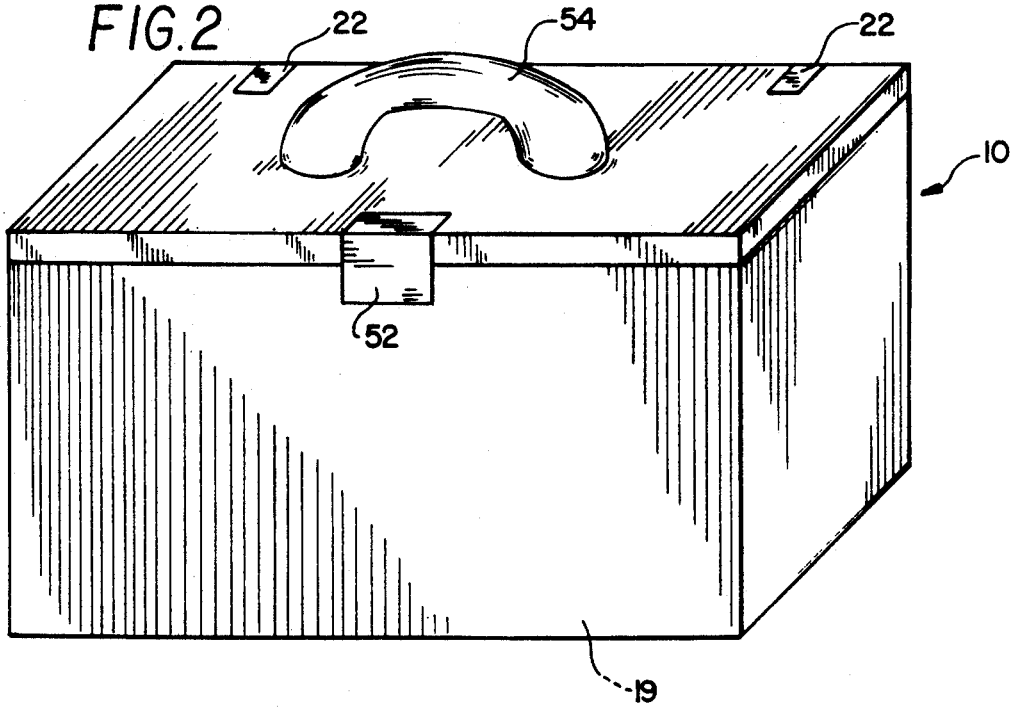
FIG. 2 is a perspective view of the carrying case closed.

FIG. 2 shows case 10 in the closed position. Handle 54 is provided on the top 20.

Figure 3:
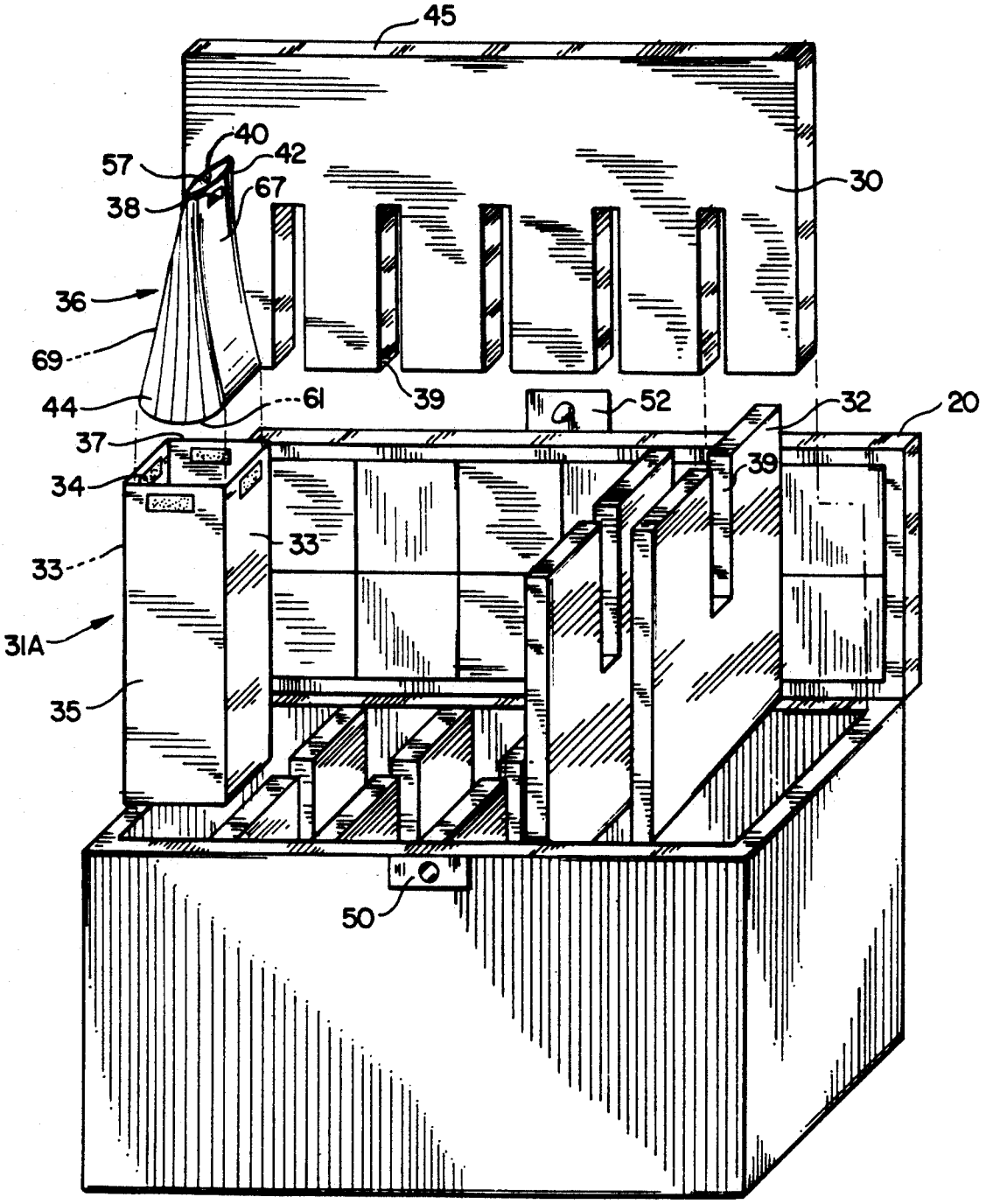
FIG. 3 is an exploded perspective view of the carrying case showing how all of the parts of the carrying case fit together.

FIG. 3 shows an exploded perspective view of how all of the parts of the carrying case 10 fit together. The case 10 is subdivided by cross member dividers 30 and longitudinal dividers 32 (hereinafter, longitudinal dividers 32 will be referred to as dividers 32).

Figure 4:
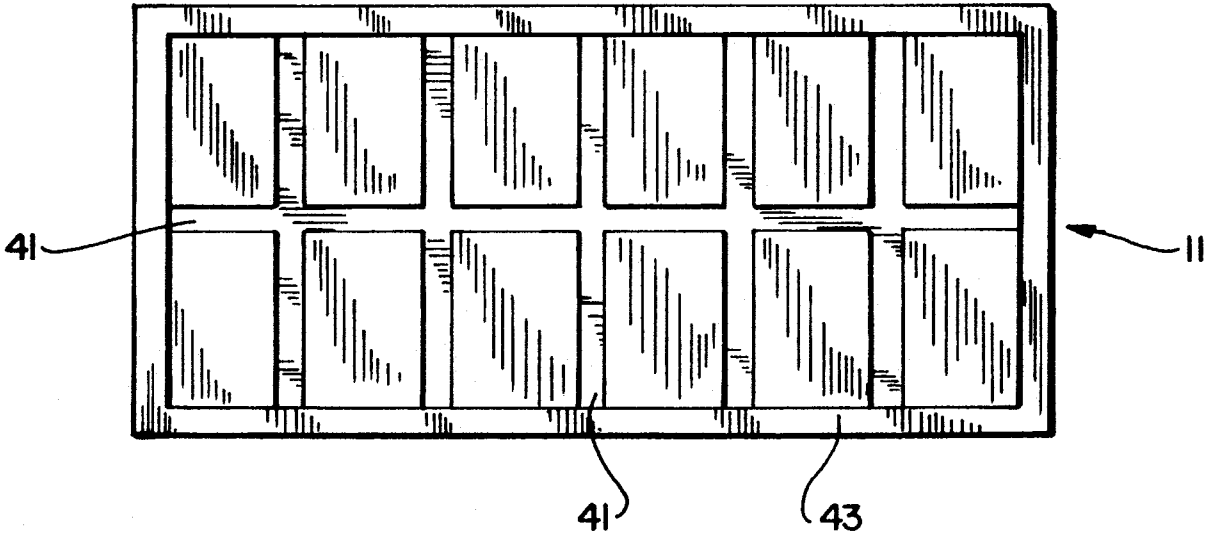
FIG. 4 is a top view of the bottom of the carrying case showing the depressions into which the dividers fit.

Compartment 31 is representative of several such compartments within the interior surface 29 of case 10. The left or right walls 33 of compartment 31 may be formed either from left side 12, right side 14 or divider 32, which is shown as being representative of several. The exterior wall 35 of compartment 31 may be formed from front side 16 or back side 18. The medial side 37 of compartment 31 may be formed by cross member divider 30. These various divider 30, 32 can be of whatever length or width is suitable to form compartment 31. The dividers 30, 32 can be secured in place by interlocking members 39 formed in each type of divider 30 or 32, slots formed between adjacent interlocking members 39 mating with cooperating slots formed in the corresponding divider 30 or 32. Dividers 30 are immobilized by being placed over a cross member divider 32, or by inserting the dividers 30, 32 in depressions 41 (see FIG. 4) located on floor 43 of interior surface 29. These depressions 41 provide positioning means for the dividers 30, 32. The dividers 30, 32 can thus be rearranged, or even entirely removed, as needed to reconfigure the compartments.

In a preferred embodiment, compartments 31 are provided by hollow rectangular members 31A.

On the top surface 45 of cross member divider 30 is identification marker 26 (seen in FIG. 1) which can be removed or changed as needed to identify the food items kept within the adjacent compartment 31.

Walls 33, as well as sides 12, 14, 16 and 18 have, at designated locations, hook and loop fasteners 34 which can be secured to corresponding hook and loop fasteners 38 on pouch 36. A plurality of pouches 36 are provided to fit within a plurality of the slotted compartments 31.

Right outside surface 67 and left outside surface 69 of pouch 36 are joined together at their respective sides by accordion sides 44. Bottom 61 is attached to the accordion sides 44 and surfaces 67 and 69. Right outside surface 67, left outside surface 69 and bottom 61 define a pouch 36. Accordion sides 44 have a pleated construction which allows pouch 36 to be expanded as needed to hold food items of various types, amounts or sizes. Opening 57 is provided at the top of pouch 36; outside surface 69 has a strip of material running across its top surface, the strip having a zipperlike construction and forming a member 40 which corresponds with a interlocking receiving member 42 at the top of surface 67, so that when the members 40, 42 are joined together, pouch 36 is sealed from the environment. Air can be removed from pouch 36 before sealing so as to store the contents of pouch 36 in a vacuum. Pouch 36 can be constructed of any flexible, pliable material having moisture resistant characteristics. It may be desired to construct pouch 36 so that it is disposable, but, in the preferred embodiment, pouch 36 would be constructed so that it can be reused. Pouch 36 has on surface 67, 69 hook loop fastening members 38 which, as noted, can be attached to corresponding members 34 on walls 33 to secure the pouch 36 in place when in use. The pouch 36 can be removed for cleaning. Further, the arrangement of the respective pouches 36, and compartments 31 therefor, can be as desired by the user.

The case 10 can be used for a variety of applications. On a vacation, weekend or holiday trip, for example, case 10 can be carried by the user and contain a variety of condiments (in packages or otherwise) such as mustard, ketchup, hot sauce, horseradish, mayonnaise, relish or similar items such as salad dressing. In a second example, case 10 could also contain various spices and herbs including gourmet spices in small amounts, such as saffron, cardamom or similar items desired by a gourmet while away from home. The case 10 can be used to carry all the condiments one would need for an outing, barbecue or day trip. A child care provider could keep within case 10 various snacks and other items that babies or children would desire while in the car or away from their own homes. Clearly, case 10 has numerous other uses which would be within the spirit of the invention.

The description provided herein is an example of the invention and is by no means the only example thereof. Other versions of the invention which fall within the spirit of the claims appended hereto are considered within the scope of the invention.

I claim:

1. A traveling case for carrying condiment packages and food items, said case comprising:

a lower portion having a left side, a right side, a front side, a back side and a bottom joined together to form said lower portion;

a top having hinges connecting said top to said lower portion, allowing said top to be opened or closed;

partitioning means within said lower portion forming compartments therein;

said partitioning means further comprising longitudinal dividers and cross member dividers which cooperate with said left, right, front and back sides to form said compartments;

said partitioning means being secured in place by positioning means;

a plurality of hollow rectangular members;

first hook and loop fasteners being attached to an outside surface of each of said hollow rectangular members;

second hook and loop fasteners being attached to an inside surface of said longitudinal dividers;

third hook and loop fasteners being attached to an inside surface of said cross member dividers;

said first hook and loop fasteners cooperating with said second hook and loop fasteners and said third hook and loop fasteners, thus removably fastening said hollow rectangular members inside said compartments;

said hollow rectangular members and said compartments being reconfigurable to form an adjustable array; and pouch means for retaining the condiments, spices or other food items within said hollow rectangular members.

2. The traveling condiment case as described in claim 1, wherein said positioning means comprise depressions formed on an interior surface of said bottom of said case for securing said dividers in place; and said longitudinal dividers and said cross member dividers having interlocking slots, whereby, when said interlocking slots are engaged, said longitudinal dividers and said cross member dividers form a plurality of compartments within said lower portion of said traveling condiment case.

3. The traveling condiment case as described in claim 1, wherein said pouch means comprises a plurality of pouches to retain the condiments, spices or other food items;

an opening at a top edge of each of said pouches;

closure means on said opening so that when each of said pouches is closed, the condiments, spices or other food items are sealed from the environment in a leakproof condition; and each of said pouches is expandable to retain food items of various types, sizes and amounts therein.

4. The traveling condiment case as described in claim 3, wherein said closure means comprise an interlocking zipperlike construction.

5. The traveling condiment case as described in claim 4, wherein each of said pouches is detachably secured to one of said hollow rectangular members by hook and loop fastener means attached to outside surfaces of each of said pouches that cooperate with hook and loop fastener means attached to inside surfaces of each of said hollow rectangular members.

6. The traveling condiment case as described in claim 3, wherein each of said pouches is detachably secured to one of said hollow rectangular members by hook and loop fasteners means attached to outside surfaces of each of said pouches that cooperate hook and loop fastener means attached to inside surfaces of each of said hollow rectangular members.

7. The traveling condiment case as described in claim 1, wherein said pouch means comprise a plurality of pouches to retain the condiments, spices or other food items;

an opening at a top edge of each of said pouches;

closure means on said opening so that when each of said pouches is closed, the condiments, spices or other food items are sealed in an airtight condition; and each of said pouches is expandable to retain food items of various types, sizes and amounts therein.

8. The traveling condiment case as described in claim 7, wherein said closure means comprise an interlocking zipperlike construction.

9. The traveling condiment case as described in claim 8, wherein each of said pouches is detachably secured to one of said hollow rectangular members by hook and loop fastener means attached to outside surfaces of each of said pouches that cooperate with hook and loop fastener means attached to inside surfaces of each of said hollow rectangular members.

10. The traveling condiment case as described in claim 7, wherein each of said pouches is detachably secured to one of said hollow rectangular members by hook and loop fastener means attached to outside surfaces of each of said pouches that cooperate with hook and loop fastener means attached to inside surfaces of each of said hollow rectangular members.

11. The traveling condiment case as described in claim 1, wherein said pouch means comprise a plurality of pouches to retain the condiments, spices or other food items;

an opening at a top edge of each of said pouches;

closure means on said opening so that when each of said pouches is closed, the condiments, spices or other food items are sealed in a moistureproof condition; and each of said pouches is expandable to retain food items of various types, sizes and amounts therein.

12. The traveling condiment case as described in claim 11, wherein said closure means comprise an interlocking zipperlike construction.

13. The traveling condiment case as described in claim 12, wherein each of said pouches is detachably secured to one of said hollow rectangular members by hook and loop fastener means attached to outside surfaces of each of said pouches that cooperate with hook and loop fastener means attached to inside surfaces of each of said hollow rectangular means.

14. The traveling condiment case as described in claim 11, wherein each of said pouches is detachably secured to one of said hollow rectangular members by hook and loop fastener means attached to outside surfaces of each of said pouches that cooperate with hook and loop fastener means attached to inside surfaces of each of said hollow rectangular members.

15. The traveling condiment case as described in claim 1, wherein said traveling condiment case further comprises content identification means.

16. The traveling condiment case as described in claim 15, wherein said content identification means comprise changeable identification markers disposed on a top surface of said cross member dividers, thereby enabling identification of contents when different contents are placed within said pouch means within said hollow rectangular members.

17. The traveling condiment case as described in claim 15, wherein said content identification means comprise changeable identification markers disposed on an inner surface of said top of said traveling condiment case, thereby enabling identification of contents when different contents are placed within said pouch means within said hollow rectangular members.

* * * * *